US007350969B2

(12) United States Patent
Maire

(10) Patent No.: US 7,350,969 B2
(45) Date of Patent: Apr. 1, 2008

(54) WATCHCASE WITH ROTATING COVER-BEZEL

(75) Inventor: François Maire, Bienne (CH)

(73) Assignee: The Swatch Group Management Services AG, Biel (CH)

( * ) Notice: Subject to any disclaimer, the term of this patent is extended or adjusted under 35 U.S.C. 154(b) by 99 days.

(21) Appl. No.: 11/334,572

(22) Filed: Jan. 19, 2006

(65) Prior Publication Data

US 2006/0158966 A1 Jul. 20, 2006

(30) Foreign Application Priority Data

Jan. 20, 2005 (EP) ..... 05001124

(51) Int. Cl.
*G04B 37/00* (2006.01)

(52) U.S. Cl. ..... 368/295

(58) Field of Classification Search ..... 368/295, 368/223, 294, 309
See application file for complete search history.

(56) References Cited

U.S. PATENT DOCUMENTS 3,757,513 A * 9/1973 Tokunaga ..... 235/61 R
4,244,044 A * 1/1981 Olsson ..... 368/291
6,616,329 B1 * 9/2003 Sasaki et al. ..... 368/294
7,080,938 B1 * 7/2006 Moore et al. ..... 368/295
7,134,784 B1 * 11/2006 Marin ..... 368/295
7,137,732 B2 * 11/2006 Takeda ..... 368/295
2005/0007337 A1 * 1/2005 Sellen et al. ..... 345/156

FOREIGN PATENT DOCUMENTS

| | | |
|---|---|---|
| CH | 161 610 | 5/1933 |
| CH | 331 285 | 7/1958 |
| CH | 337 138 | 3/1959 |
| EP | 0 297 195 A | 1/1989 |
| EP | 0 488 355 A2 | 6/1992 |
| EP | 1 189 118 A1 | 3/2002 |
| EP | 1 211 577 A1 | 6/2002 |
| FR | 2 626 985 A | 8/1989 |
| WO | WO 2004/088436 A2 | 10/2004 |

* cited by examiner

*Primary Examiner*—Gary F. Paumen
(74) *Attorney, Agent, or Firm*—Sughrue Mion, PLLC

(57) ABSTRACT

The watchcase includes a middle part (3) closed by a back cover (5) delimiting a housing (7) provided for receiving a watch movement (9) including at least one off-centre display (10, 12). The external surface is entirely covered by a cover-bezel (1) rotatably mounted in the plane of the case on an axis (15) located at the centre of the case and it includes at least one aperture (20) having the same contour as the display (10, 12) and able to occupy a first position in which said display (10, 12) is visible, and another position in which said display (10, 12) is concealed.

11 Claims, 2 Drawing Sheets

WATCHCASE WITH ROTATING COVER-BEZEL

This application claims priority from European Patent Application No. 05001124.6 of Jan. 20, 2005, the entire disclosure of which is incorporated herein by reference.

FIELD OF THE INVENTION

The present invention concerns a watchcase including a cover-bezel that rotates in the plane of the watch to reveal or conceal at will at least one subjacent display.

BACKGROUND OF THE INVENTION

Numerous devices have already been proposed for concealing a timepiece display, either in order to protect it, as was the case for pocket watches, or for an aesthetic purpose, for example in order to give wristwatches the appearance of a piece of jewelry, outside the brief moments when one wished to consult the time.

A first type of device is the so-called "reversible" or "reverso" watches, illustrated for example in Patent Nos. CH 161 610, EP 1 189 118 or WO 2004/088436. With all the embodiments disclosed, the mechanism for turning the case over through 180° against the back cover of the case-support is complex. It implements hinged arms, pivots, slide-bars, etc. . . . which make the final product relatively expensive, and even fragile and often difficult to handle.

In order to achieve the same purpose, a second type of device relies on one or two shutters sliding in rectilinear grooves in the case, above the display. Such devices correspond for example to the embodiments disclosed in Patent Nos. CH 331 285, CH 337 138 and EP 1 211 577. These constructions are simpler than the preceding ones, but still have the drawback of limiting the watchcase to a rectangular shape, creating new complications, in particular as regard the horns if the shutters slide along the 6 o'clock-12 o'clock axis. Such devices also have the drawback of becoming increasingly difficult to handle because of the gradual accumulation of dirt in the slideways in which the shutters slide.

A third type of device includes a cover that is mobile in rotation in the plane of the watch to reveal or conceal a subjacent display, illustrated for example by EP Patent No. 0 488 355 including an analogue and digital liquid crystal display (LCD). In the device disclosed a disc, arranged between the back face of the dial and the LCD displays, can be rotated, either to make said displays appear through apertures made in the dial, or, conversely, to conceal them. Since it is not possible to manoeuvre the cover from outside the watch, a relatively complex mechanical drive system is provided.

SUMMARY OF THE INVENTION

It is thus an object of the present invention to overcome the drawbacks of the prior art by providing a watchcase with a rotating cover-bezel of simple construction that is easy to manipulate to conceal or reveal at least one subjacent display.

The invention therefore concerns a watchcase with a rotating cover-bezel comprising a middle part closed by a back cover delimiting a housing provided for receiving a watch movement including at least one off-centre analogue or digital type display. The case is characterized in that the cover-bezel is rotatably mounted in the plane of the case on an axis located at the centre of the case and it includes at least one aperture having the same contour as the display and able to occupy a first position in which said display is visible and another position in which said display is concealed.

Thus by rotating the cover-bezel it is easy to alter the appearance of the watch for an aesthetic purpose or to protect the subjacent display.

With the same construction it is also possible to having more than one display insofar as the aperture of the cover-bezel can occupy a position in which it is not above any of the displays. One could for example have two displays that are symmetrical in relation to the centre of rotation of the cover-bezel, one of the digital type and the other of the analogue type.

BRIEF DESCRIPTION OF THE DRAWINGS

Other features and advantages of the present invention will appear more clearly in the following description of embodiment examples, given by way of illustrative and non-limiting example with reference to the annexed drawings, in which.

DETAILED DESCRIPTION OF THE INVENTION

Figure 1:
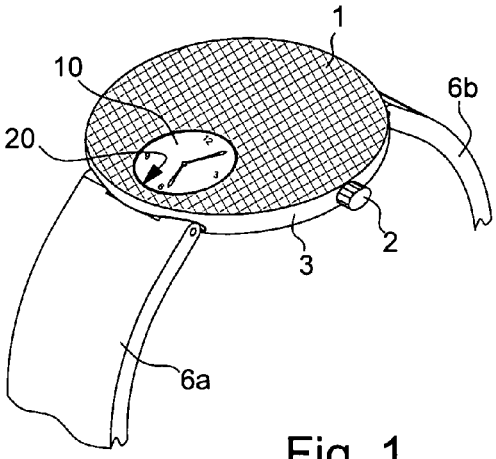
FIG. 1 is a perspective view of a first embodiment of a wristwatch according to the invention shown with a visible display.
Figure 2:
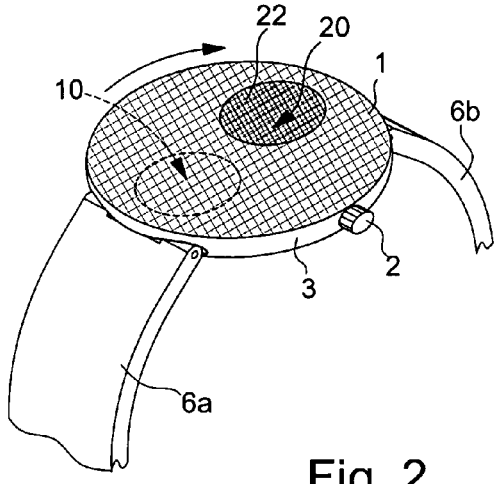
FIG. 2 corresponds to FIG. 1 when the display is concealed.

In a first embodiment concerning a wristwatch, shown in FIGS. 1 and 2, the essential assembling element of the case is formed by a circular middle part 3, through which a control member, represented by a crown 2, passes. The top part of middle part 3 is entirely covered by a cover-bezel 1, which is mobile in rotation in the plane of the watch. As will be described in more detail hereinafter, the case encloses a watch movement 9 for displaying time-related information on a display 10, off-centre in relation to the centre of the case, i.e. whose contour does not extend beyond said centre. In this example, display 10 is of the analogue type and it also has a circular shape occupying one part of the bottom quarter of the case at the usual 6 o'clock position.

As can be seen in FIG. 1, cover-bezel 1 includes an aperture 20, having substantially the same contour as that of display 10, and positioned above said display 10 to make it visible.

In FIG. 2, cover-bezel 1 has been rotated through 180°, such that display 10 is now concealed and aperture 20 is located above a zone 22 of the case that does not include any displays. For aesthetic purposes, zone 22 can be made such that it has the same appearance as the outer surface of cover-bezel 1, i.e. making aperture 20 practically invisible.

Figure 3:
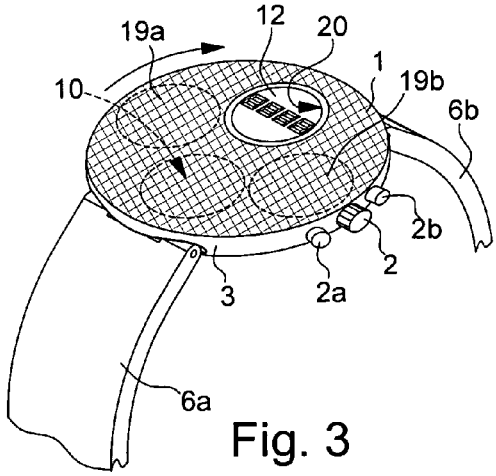
FIG. 3 is a perspective view of a second embodiment of a wristwatch according to the invention shown with a second visible display.

FIG. 3 illustrates a second embodiment wherein the wristwatch includes a second display 12, which is represented by a digital liquid crystal display (LCD) and above which it is possible to position aperture 20, the rest of cover-bezel 1 concealing first display 10. If one wishes to conceal both displays 10, 12 at the same time, cover-bezel 1 only needs to be rotated through 90° in one or other direction to bring aperture 20 into one of the positions 19*a* or 19*b*.

Depending upon the wishes of the designer, it would evidently be possible within the scope of the invention, to make cover-bezel 1 with two apertures 20, to make two displays 10, 12 visible at the same time, or conversely, to conceal them both.

Figure 4:
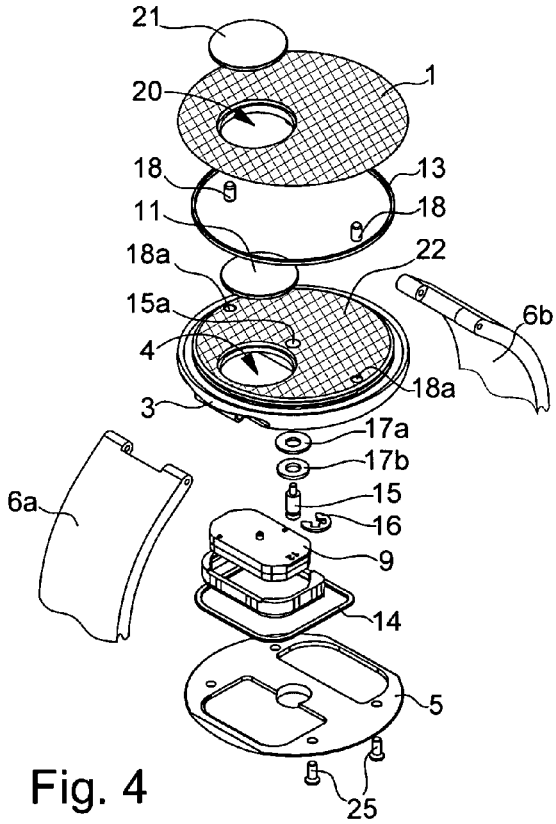
FIG. 4 is an exploded perspective diagram of the wristwatch shown in FIG. 1.
Figure 5:
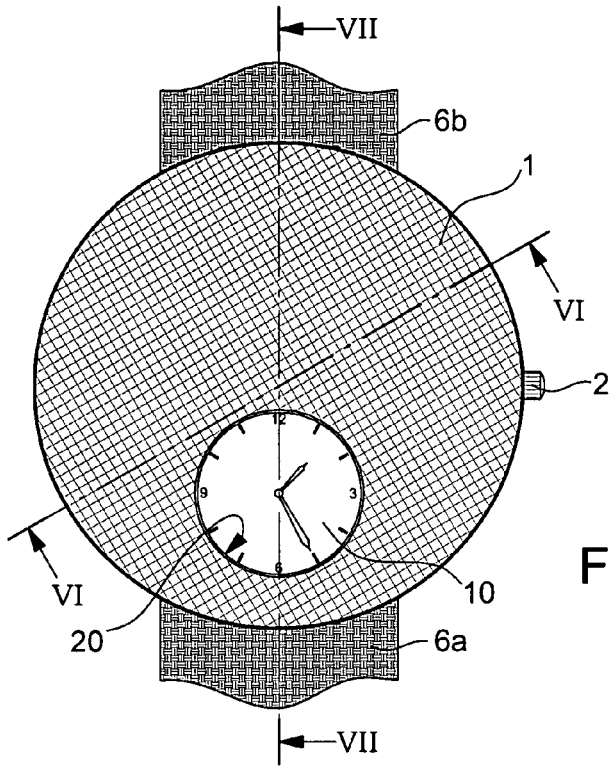
FIG. 5 is a top view of the wristwatch shown in FIG. 1.
Figure 6:
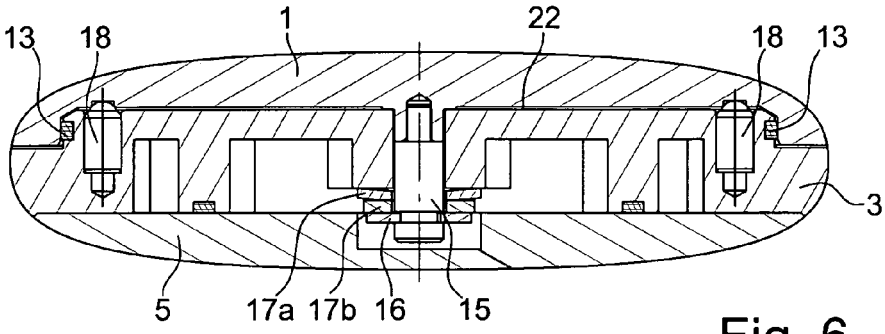
FIG. 6 is a cross-section along the line VI-VI of FIG. 5.
Figure 7:
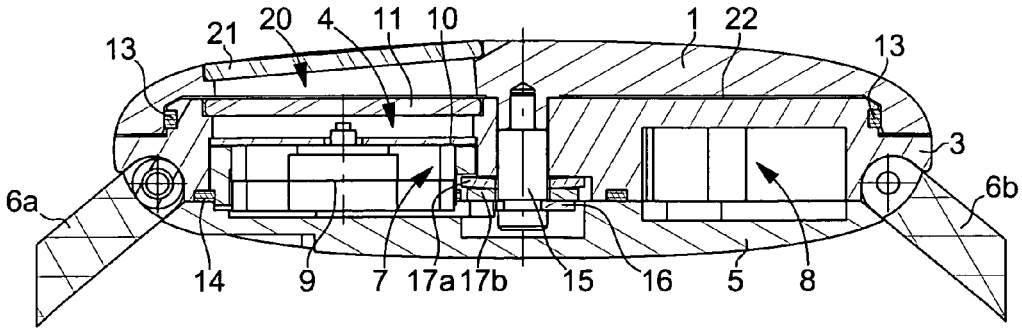
FIG. 7 is a cross-section along the line VII-VII of FIG. 5.

Referring now to FIGS. 4 to 7, the construction details of the embodiment shown in FIGS. 1, 2 and 5 will now be described, which is a top view to show the cross-sectional planes corresponding to FIGS. 6 and 7.

In the exploded perspective diagram of FIG. 4, it can be seen that the wristwatch includes a central assembly element formed by a middle part 3 including a circular joining plate 22 provided with an off-centre circular aperture 4, in which a crystal 11 is fitted. This central assembly element 3 allows wristband strands 6*a*, 6*b* to be attached, cover-bezel 1 to be assembled to the top part and movement 9 to be mounted in the bottom part.

Cover-bezel 1 covers the entire external surface of the wristwatch and includes an aperture 20 closed by a crystal 21, having the same contour as aperture 4 and capable of being positioned above said aperture, as appears more clearly in the cross-section of FIG. 7. Cover-bezel 1 is fixed to middle part 3 by means of a holding element 15, passing through an aperture 15*a* located at the centre of joining plate 22. One end of said element 15 is driven into the thickness of cover-bezel 1, and the other end including a groove in which a circlip 16 engages after insertion of a live spring action washer 17*a*, and a friction limiting washer 17*b*. Prior to assembly, ball catches 18 are set in place in blind holes 18*a* provided in joining plate 22, and a sealing gasket 13, as can be seen more clearly in the cross-section of FIG. 6.

It is then possible to assemble the bottom part by placing movement 9 and its sealing gasket 14 in a housing 7 provided for this purpose, as can be seen in the cross-section of FIG. 7. It can also be seen that the central assembly element 3 includes another housing 8, either to make the product lighter or to receive other components, for example watch related components, if the wristwatch includes another display 12. Finally, back cover 5 is closed, which in this case is screwed by means of screws 25.

The preceding description was made with reference to a watch having a circular case. However, given the rotation of the cover-bezel about a central holding element 15, it will be understood that one is not limited to a circular shape. By carrying out alteration within the grasp of those skilled in the art, concerning for example the shape and position of sealing gasket 13, it is possible to make a wristwatch having a case of oblong, rectangular or oval shape, in accordance with the same principles.

What is claimed is:

1. A watchcase with a rotating cover-bezel including a middle part closed by a back cover delimiting a housing provided for receiving a watch movement including at least one off-centre display, wherein the cover-bezel is rotatably mounted in the plane of the case about an axis located at the centre of the case and it includes at least one aperture having the same contour as each display, and wherein said cover bezel can occupy, by rotating, a first position making a first display visible, a second position making a second display visible and a third position in which no display is visible.

2. The watchcase according to claim 1, wherein one display is of the analogue type and the other display is of the digital liquid crystal type.

3. The watchcase according to claim 1, wherein it includes ball catches arranged between the middle part and the cover-bezel to hold the latter in a determined position.

4. The watchcase according to claim 1, wherein, when no display is visible, the aperture of the cover-bezel is positioned above a portion of the case having the same appearance as the external surface of the cover-bezel.

5. The watchcase according to claim 1, wherein a crystal is mounted on the display and the aperture is closed by another crystal.

6. The watchcase according to claim 4, wherein the crystals of the display and the aperture have curves provided to produce a magnifying effect.

7. The watchcase according to claim 1, wherein the middle part and the cover-bezel have a circular shape.

8. The watchcase according to claim 1, wherein the middle part and the cover-bezel have an oblong shape.

9. A watchcase with a rotating cover-bezel including a middle part closed by a back cover delimiting a housing provided for receiving a watch movement including at least one off-centre display, wherein the cover-bezel is rotatably mounted in the plane of the case about an axis located at the centre of the case and it includes at least one aperture having the same contour as the display and able to occupy a first position in which said display is visible, and another position in which said display is concealed, and wherein, when no display is visible, the aperture of the cover-bezel is positioned above a portion of the case having the same appearance as the external surface of the cover-bezel.

10. A watchcase with a rotating cover-bezel including a middle part closed by a back cover delimiting a housing provided for receiving a watch movement including at least one off-centre display, wherein the cover-bezel is rotatably mounted in the plane of the case about an axis located at the centre of the case and it includes at least one aperture having the same contour as the display and able to occupy a first position in which said display is visible, and another position in which said display is concealed, and wherein a crystal is mounted on the display and the aperture is closed by another crystal.

11. The watchcase according to claim 10, wherein the crystals of the display and the aperture have curves provided to produce a magnifying effect.

* * * * *